US007240802B2

(12) United States Patent
Jones

(10) Patent No.: US 7,240,802 B2
(45) Date of Patent: Jul. 10, 2007

(54) HIGH HEEL SHOE BUSINESS CARD HOLDER

(75) Inventor: Brenda S. Jones, Raleigh, NC (US)

(73) Assignee: Adstracts, Inc., Raleigh, NC (US)

( * ) Notice: Subject to any disclaimer, the term of this patent is extended or adjusted under 35 U.S.C. 154(b) by 0 days.

(21) Appl. No.: 11/167,760

(22) Filed: Jun. 27, 2005

(65) Prior Publication Data

US 2006/0289366 A1 Dec. 28, 2006

(51) Int. Cl.
*A47F 7/14* (2006.01)

(52) U.S. Cl. ..... 211/50; 211/13.1; 211/10

(58) Field of Classification Search ..... 211/50; D02/896, 897, 916, 936; 36/11.5, 34 R
See application file for complete search history.

(56) References Cited

U.S. PATENT DOCUMENTS

| | | | | | |
|---|---|---|---|---|---|
| D105,230 | S | * | 7/1937 | Pelinger | D2/897 |
| D110,448 | S | * | 7/1938 | Sholta | D2/930 |
| 2,707,341 | A | * | 5/1955 | Romano | 36/34 R |
| 2,836,906 | A | * | 6/1958 | Josephi | 36/34 R |
| 2,952,925 | A | * | 9/1960 | Held | 36/97 |
| D193,087 | S | * | 6/1962 | Levine | D2/930 |
| D201,665 | S | * | 7/1965 | Levine | D2/930 |
| D205,883 | S | * | 10/1966 | Post | D2/939 |
| D378,160 | S | * | 2/1997 | Wells et al. | D2/897 |
| D452,771 | S | * | 1/2002 | Jacobs | D2/930 |
| D461,626 | S | * | 8/2002 | Hisamatsu | D2/926 |
| 2002/0194750 | A1 | * | 12/2002 | Feick | 36/101 |
| 2004/0244225 | A1 | * | 12/2004 | Ostow | 36/101 |

* cited by examiner

*Primary Examiner*—Richard E. Chilcot, Jr.
*Assistant Examiner*—Lindsay M. Maguire
(74) *Attorney, Agent, or Firm*—Myers Bigel Sibley & Sajovec

(57) ABSTRACT

A business card holder having the shape of a lady's high heel shoe includes a rigid, elongated sole having a rigid toe portion, a rigid inclined heel portion, and a rigid intermediate portion between the toe portion and inclined heel portion. A rigid heel extends downwardly from the inclined heel portion and supports the inclined heel portion when the business card holder is in an operative position. A rigid shoe upper extends over the toe portion and includes a free edge portion. The shoe upper free edge portion, sole intermediate portion, and inclined heel portion define a pocket that is configured to hold a plurality of business cards for distribution therefrom.

8 Claims, 3 Drawing Sheets

HIGH HEEL SHOE BUSINESS CARD HOLDER

FIELD OF THE INVENTION

The present invention relates generally to article holders and, more particularly, to holders for office supplies and the like.

BACKGROUND OF THE INVENTION

Desk organizers for holding various office accessories, such as pens, pencils, memo pads, papers, documents and envelopes, clips, scissors, business cards, and the like, are known. These organizers are advantageous in that the can help eliminate desk clutter. Unfortunately, many such organizers lack distinctiveness and are not aesthetically pleasing. Thus, there is a need for desk organizers that are distinctive and more aesthetically pleasing from a visual point of view.

SUMMARY OF THE INVENTION

In view of the above discussion, a business card holder having the shape of a lady's high heel shoe is provided and includes a rigid, elongated sole having a rigid toe portion, a rigid inclined heel portion, and a rigid intermediate portion between the toe portion and inclined heel portion. A rigid heel extends downwardly from the inclined heel portion and supports the inclined heel portion when the business card holder is in an operative position (i.e., when the business card holder is on a generally horizontal surface). A rigid shoe upper extends over the toe portion and includes a free edge portion. The shoe upper free edge portion, sole intermediate portion, and inclined heel portion define a pocket that is configured to hold a plurality of business cards for distribution therefrom.

The business card holder is unsuitable for wear as a shoe by a person. Unlike an actual shoe that can be worn, the business card holder is substantially rigid, is too small for a person's foot, and is not capable of supporting the weight of a person.

DETAILED DESCRIPTION OF THE INVENTION

Figure 1:
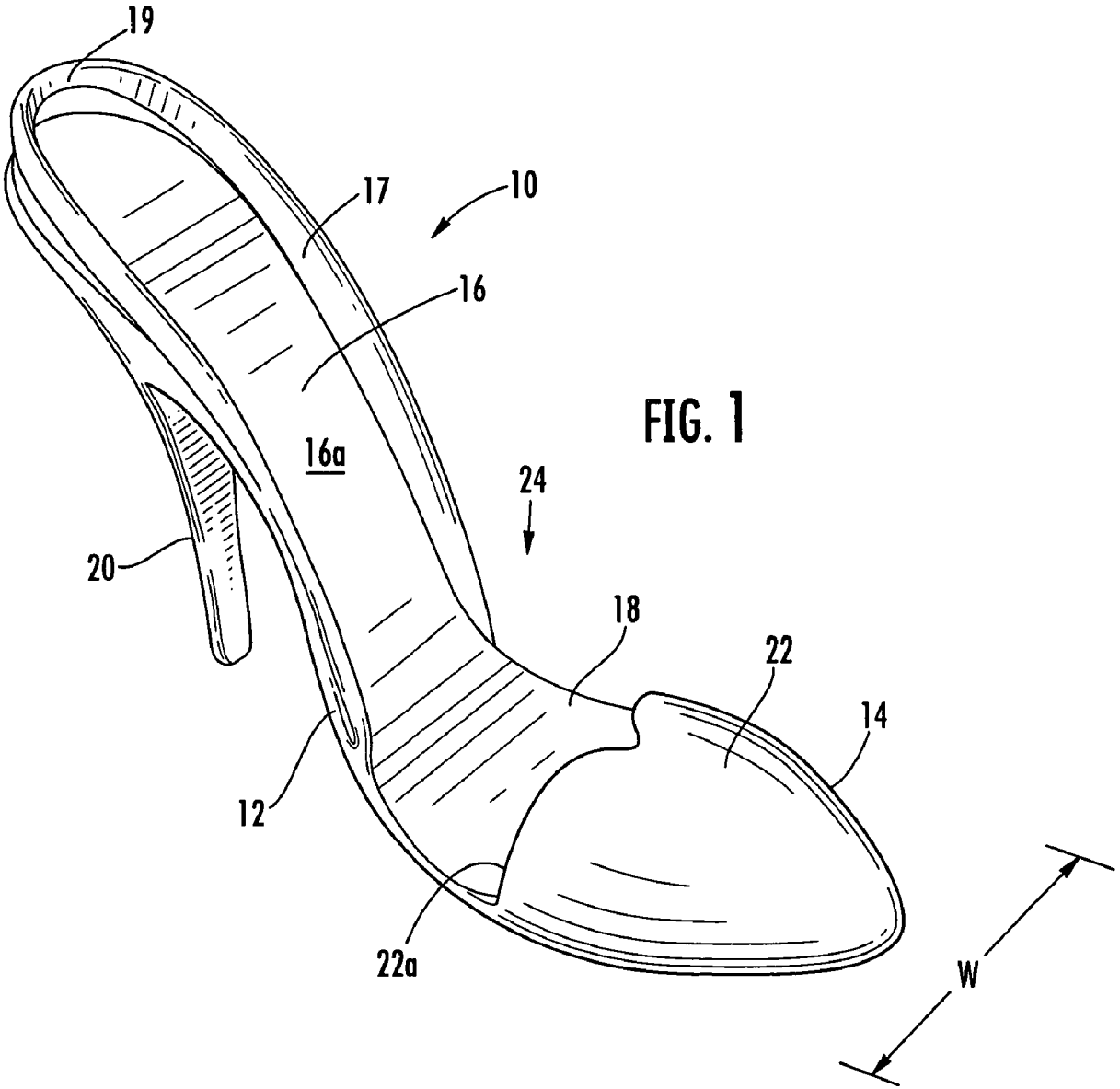
FIG. 1 is a perspective view of a business card holder, according to embodiments of the present invention.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise. All publications, patent applications, patents, and other references mentioned herein are incorporated herein by reference in their entireties.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a "first" element, component, region, layer or section discussed below could also be termed a "second" element, component, region, layer or section without departing from the teachings of the present invention. The sequence of operations (or steps) is not limited to the order presented in the claims or figures unless specifically indicated otherwise.

Figure 2:
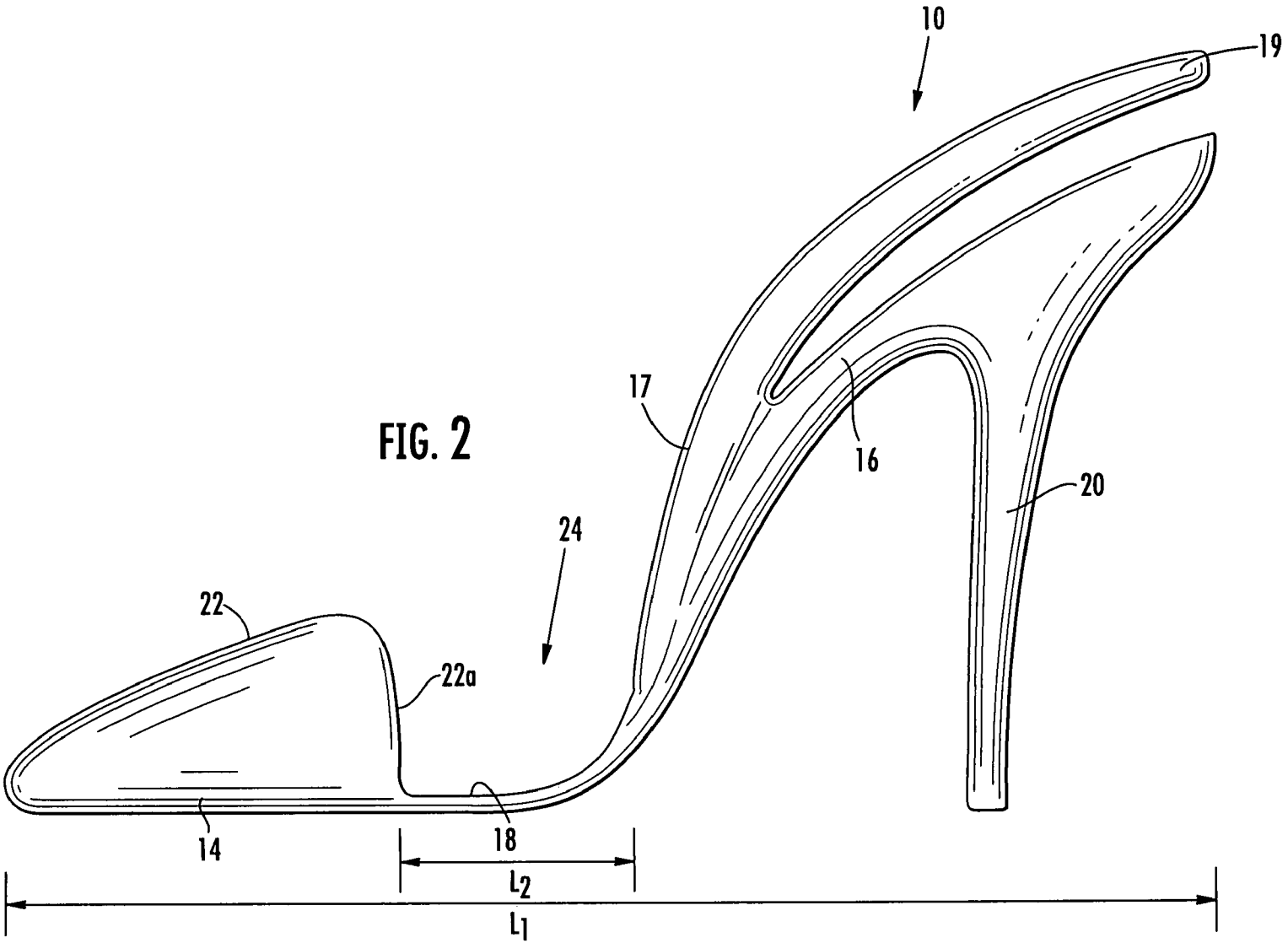
FIG. 2 is a side elevation view of the business card holder of FIG. 1.
Figure 3:
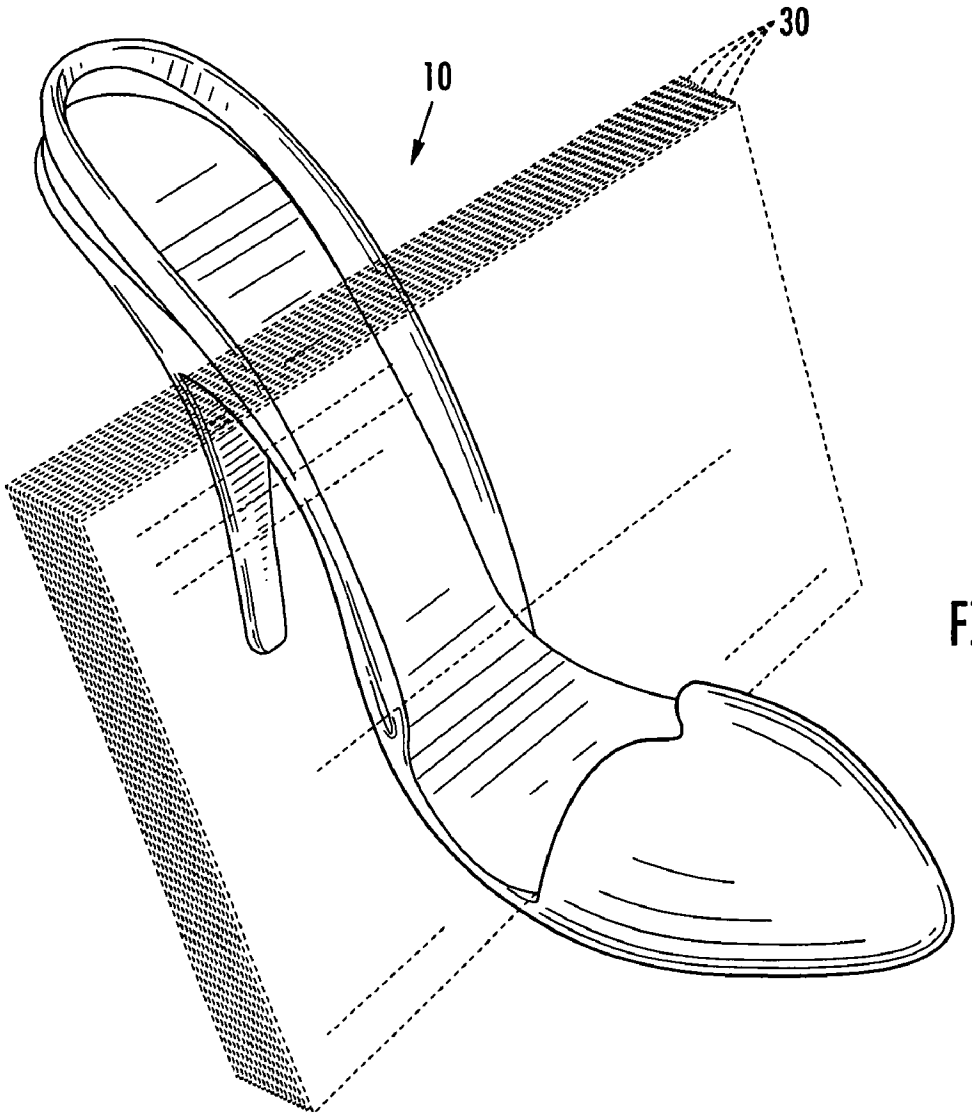
FIG. 3 is a perspective view of the business card holder of FIG. 1, with a plurality of business cards retained within the pocket thereof.

Referring now to FIGS. 1-3, a business card holder 10 according to an embodiment of the present invention is illustrated. The illustrated business card holder 10 has the shape of a lady's high heel shoe; however, the business card holder 10 is unsuitable for wear as a shoe by a person. The business card holder 10 is too small for a person's foot and is not capable of supporting the weight of a person. For example, the business card holder has a length $L_1$ of less than or equal to 5 inches, and a width W of less than or equal to 2.5 inches, and preferably a length $L_1$ of less than or equal to 3.6 inches, and a width W of less than or equal to 1.3 inches.

The illustrated business card holder 10 includes a rigid, elongated sole 12 having a rigid toe portion 14, a rigid inclined heel portion 16, and a rigid intermediate portion 18 between the toe portion 14 and inclined heel portion 16. A rigid heel 20 extends downwardly from the inclined heel portion 16 and supports the inclined heel portion 16 when the business card holder 10 is in an operative position (i.e., when the business card holder 10 is on a generally horizontal surface). The illustrated heel 20 is a spike heel (also referred to as a stiletto heel). However, other styles of high heels may be utilized, without limitation.

In the illustrated embodiment, the inclined heel portion 16 includes a rigid raised edge 17 that extends around the periphery of the inclined heel portion 16. A portion 19 of the rigid raised edge 17 separates from the inclined heel portion 16 to give the appearance of a heel strap, as illustrated in FIG. 2.

A rigid shoe upper 22 extends over the toe portion 14 and includes a free edge portion 22*a*. The shoe upper 22 substantially covers the toe portion 14 in the illustrated embodiment. However, the shoe upper 22 may have various configurations, shapes, etc., without limitation. The shoe upper free edge portion 22*a*, sole intermediate portion 18, and inclined heel portion 16 define a pocket 24 that is configured to hold a plurality of business cards 30 for distribution therefrom, as illustrated in FIG. 3. In the illustrated embodiment, the raised edge 17 provides support to business cards 30 retained within the pocket 24. The illustrated raised edge 17 helps maintain business cards 30 in a substantially upright position, as shown in FIG. 3.

According to embodiments of the present invention, the sole intermediate portion 18 between the shoe upper free edge portion 22*a* and inclined heel portion 16 has a length $L_2$ of less than or equal to 2 inches, and preferably less than or equal to 1.5 inches. The toe portion 14 and intermediate portion 18 are configured to lie substantially flat on a generally horizontal surface when the business card holder 10 is in an operative position, as illustrated in FIG. 2.

Unlike an actual shoe that can be worn, the business card holder 10 is substantially rigid. For example, the elongated sole 12, rigid toe portion 14, rigid inclined heel portion 16, rigid intermediate portion 18 rigid heel 20, and rigid raised edge 17 are formed from substantially rigid material including, but not limited to, rigid polymeric material, wood, metal, glass, etc. The business card holder 10 may be formed from a single piece of rigid material, or may be the combination of various rigid pieces of material. For example, the sole 12 and heel 20 may be separate rigid pieces joined together. Alternatively, the business card holder 10 may be formed via a mold as a unitary article.

According to embodiments of the present invention, the toe portion 14 and/or the heel 20 of the business card holder 10 may include additional weight to help maintain the business card holder 10 in the operative position. For example, the toe portion 14 and/or heel 20 may include weights and/or may include heavier/denser material. Moreover, the toe portion 14 and/or heel 20 may be configured to be removably secured to a surface, such as via adhesive, hook and loop fasteners, and the like. The business card holder 10 may also be mounted to a platform or other supporting structure.

According to embodiments of the present invention, the business card holder 10 may include promotional indicia. If the business card holder 10 is mounted to a supporting platform, the platform may also include promotional indicia.

According to embodiments of the present invention, the elongated sole upper surface 16*a* may have a decorative appearance. For example, the elongated sole upper surface 16*a* may have decorative material and/or designs thereon. Moreover, the material of the business card holder 10 may have one or more colors and/or one or more designs.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. The invention is defined by the following claims, with equivalents of the claims to be included therein.

That which is claimed is:

1. A business card and cardholder in the shape of a shoe having a heel, comprising:

a rigid, elongated sole having a toe portion, an inclined heel portion, and a flat intermediate portion having an upwardly facing surface extending between and connecting the toe portion and inclined heel portion, wherein the flat sole intermediate portion surface is horizontal when the business card holder is in an operative position on a horizontal surface;

a rigid heel extending downwardly from the inclined heel portion that supports the inclined heel portion; and a rigid shoe upper extending over the toe portion, wherein the rigid shoe upper comprises a free edge portion, wherein the shoe upper free edge portion, flat sole intermediate portion surface, and inclined heel portion define a pocket configured to hold a plurality of business cards for distribution therefrom, and wherein the flat sole intermediate portion surface supports business cards placed directly in contact therewith between the shoe upper free edge portion and inclined heel portion.

2. The business card holder of claim 1, wherein the toe portion and intermediate portion are configured to lie substantially flat on a surface when the business card holder is in an operative position.

3. The business card holder of claim 1, wherein the inclined heel portion comprises a rigid raised edge extending around a periphery thereof.

4. The business card holder of claim 1, wherein the heel is a spike heel.

5. The business card holder of claim 1, wherein the elongated sole, heel, and shoe upper are formed from polymeric material, wood, glass, or metal.

6. A business card and cardholder in the shape of a shoe having a heel, comprising:

a rigid, elongated sole having a toe portion, an inclined heel portion, and a flat intermediate portion having an upwardly facing surface extending between and connecting the toe portion and inclined heel portion;

a rigid heel extending downwardly from the inclined heel portion that supports the inclined heel portion; and a rigid shoe upper extending over the toe portion, wherein the rigid shoe upper comprises a free edge portion, wherein the shoe upper free edge portion, flat sole intermediate portion surface, and inclined heel portion define a pocket configured to hold a plurality of business cards for distribution therefrom, wherein the flat sole intermediate portion surface supports business cards placed directly in contact therewith between the shoe upper free edge portion and inclined heel portion, wherein the toe portion and flat sole intermediate portion are configured to lie substantially flat on a surface when the business card holder is in an operative position, wherein the inclined heel portion comprises a rigid raised edge extending around a periphery thereof, and wherein a portion of the raised edge is substantially orthogonal to the flat sole intermediate portion surface.

7. The business card holder of claim 6, wherein the heel is a spike heel.

8. The business card holder of claim 6, wherein the elongated sole, heel, and shoe upper are formed from polymeric material, wood, glass, or metal.

* * * * *